United States Patent [19]

Butterwick

[11] 4,160,188

[45] Jul. 3, 1979

[54] ELECTRON BEAM TUBE

[75] Inventor: Gilbert N. Butterwick, Leola, Pa.

[73] Assignee: The United States of America as represented by the Secretary of the Navy, Washington, D.C.

[21] Appl. No.: 680,003

[22] Filed: Apr. 23, 1976

[51] Int. Cl.[2] ..... H01J 29/02; H01J 29/48; H01J 29/46

[52] U.S. Cl. ..... 313/446; 313/366; 313/482

[58] Field of Search ..... 313/477, 446, 482, 390, 313/366, 270, 447

[56] References Cited

U.S. PATENT DOCUMENTS

| | | | |
|---|---|---|---|
| 1,932,084 | 10/1933 | Opsahl | 313/477 X |
| 3,830,717 | 8/1974 | Singer et al. | 313/366 X |

FOREIGN PATENT DOCUMENTS

| | | | |
|---|---|---|---|
| 233969 | 8/1944 | Switzerland | 313/446 |
| 1377364 | 12/1974 | United Kingdom | 313/477 |

*Primary Examiner*—Robert Segal
*Attorney, Agent, or Firm*—R. S. Sciascia

[57] ABSTRACT

An electron beam tube having a cold cathode capable of being used as a camera tube or a display tube. The tube is constructed of two sections which are fitted together in a vacuum. The first section includes the tube neck and face section and an annular opening having a taper at the end thereof. The second section houses the cold cathode and a surface contact area for abuttably engaging a resilient electrical connector housed in the first section. The second section is forceably fitted over the taper on the first section to effect a vacuum tight seal.

4 Claims, 4 Drawing Figures

ELECTRON BEAM TUBE

The invention described herein may be manufactured by or for the government of the United States of America for governmental purposes without the payment of royalties thereon or therefor.

BACKGROUND

This invention relates to the field of tubes or cameras having an electron beam emitting source therein, and more particularly to a tube or camera having a cold cathode emitter.

A variety of applications exist for an inexpensive, easily constructed tube or camera having a cold cathode. The attributes of such an electron source are significant. For example, a cold cathode emitter requires no heater to produce an electron beam such as required by a thermionic cathode having a filament heater, hence the power requirements are substantially lower. Also, the cold cathode structure is more rugged since one may eliminate the delicate filament. The cold cathode is capable of very high emission current density while providing an extremely narrow emission velocity distribution. This feature provides a display tube having high brightness capability as well as high resolution. When the cold cathode is employed in combination with a camera tube, the narrow emission velocity distribution produces higher resolution capability. Also, the low energy input segments improve the portability of the necessary voltage source.

SUMMARY

An electron beam tube can be considered having three basic parts, the face section, the neck and the cold cathode section. Tube construction is effected by providing a vacuum tight cold cathode cap type section over the end of the neck section so that each section engages with the other to insure a vacuum seal. The cold cathode includes a P-N type junction and receives its power from a frustro-conical resilient metal contact engaged against the surface of the layered P-N junction. Manufacturing of this device is simple and inexpensive since each of the two sections may be made individually and then sequentially put together and sealed in a vacuum.

OBJECTS

Therefore, it is an object of the present invention to provide a simply constructed electron tube having a cold cathode which may be modified for use as either a camera or a display tube.

Another object of the present invention is to provide a cold cathode electron source disposed within an electron tube wherein the cathode is constructed from a silicon P-N junction capable of providing a high escape probability for electrons injected at the junction.

These and other objects of the invention will become apparent when referring to the drawing wherein:

DRAWING

DESCRIPTION OF OPERATION

Figure 1:
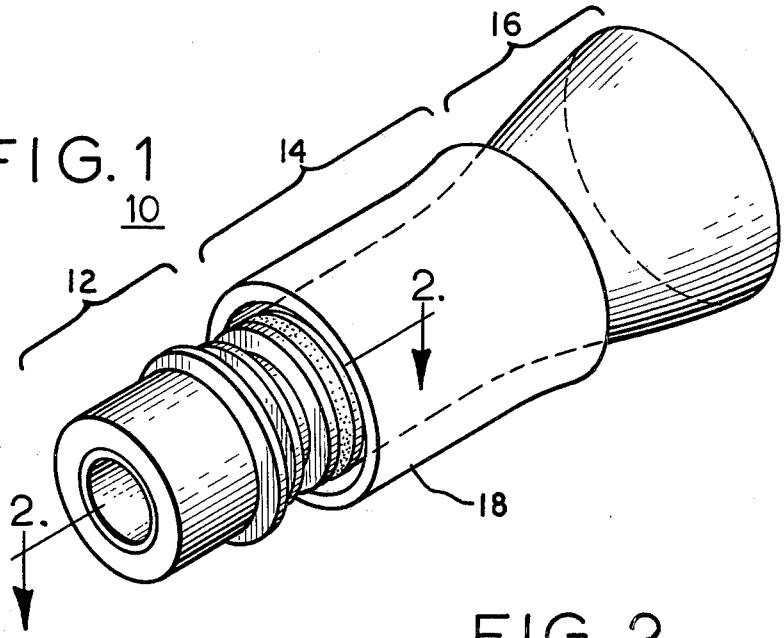
FIG. 1 is a typical example of the type of tube contemplated by the invention.

Referring to FIG. 1, tube 10 can be considered to have three basic sections; the cold cathode section 12, the neck 14 and the tube face section 16. Each of the sections are integrally connected to provide a camera tube or display tube. Face 16 is selected in accordance with the use contemplated and may be designed in any manner well known in the art. Similarly, neck 14 surrounded by alignment, focus, and scanning coils 18, are selected and operated in the conventional manner. The cold cathode section 12 in combination with the neck 14 and face 16 comprise the vacuum sealed cold cathode tube as contemplated by this invention.

Figure 2:
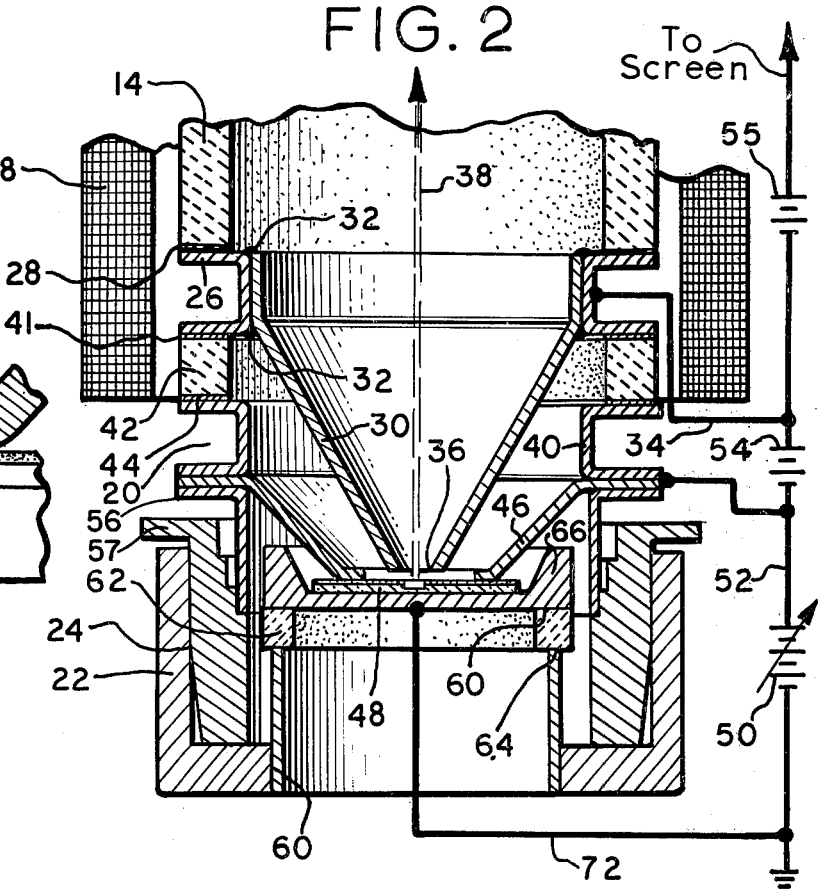
FIG. 2 is a cross-sectional view of the neck and cold cathode portion of the tube shown in FIG. 1.

Referring to FIG. 2, cold cathode section 12 is constructed of two sections 20 and 22 and are sealed at the taper 24. Cathode assembly 20 is integrally connected to neck 14. Cap 22 is constructed as a unit and harbors the cold cathode and when its manufacture is complete it is slidably positioned over cathode assembly 20 at the taper 24 under vacuum conditions.

Cathode assembly 20 is attached to the neck 14 by U-shaped ring 26. As shown in FIG. 2, ring 26 is brazed to neck 14 by an annular braze 28. Although neck 14 may be of many types of material, I employ an insulation material such as a high-alumina ceramic sintered with molybdenum and provide a nickel plating only on the surfaces in which a solder is to be effected. Such a nickel coating is provided on the neck 14. Ring 26 is made of an iron nickel alloy such as Kovar and supports the field forming frustrum 30. Frustrum 30 may be integrally attached to ring 26 in any well known manner such as an electrical spot weld 32. The field forming frustrum 30 is a positively biased electrode supplied by power source 54 through lead 34. Although any recognized metal may be used as an electrode, stainless steel is preferred because it is easily manipulated and formed and cleaned easily. Frustrum 30 has a hole 36 sufficient in size to permit the generated electron beam 38 to sweep across the entire face section 16. The potential applied by power source 54 provides an electric field distribution to accelerate the emitted electron beam and also prevent the beam 38 from diverging while traveling to the screen or target.

A second U-shaped ring 40 is secured to insulation spacer 42 by solder joint 44. Also spacer 42 is soldered to ring 26 by solder 46. Spacer 42 may be of the same material as neck 14 and has a nickel or other metal coating at those points where soldering is contemplated. Aslo, ring 40 may be of the same material as ring 26.

A metallic, resilient contact ring 46 is welded to ring 40. The purpose of the contact ring is to form the P contact engagement with the P-N wafer 48 when cap structure 22 slidably engages assembly 20. Accordingly, it is of a frustro-conical shape with an annular opening at the bottom so as not to inhibit the electron beam 38. The size of contact ring 46 must be such that sufficient pressure is exerted against the P-N wafer 48 to assure good electrical conductivity. Contact ring 46 provides electrical current from power source 50 by lead 52 when the cap 22 is sealably connected to cathode assembly 20.

Cap 22 has a cylindrical structure welded thereto for supporting an insulating ring 62. Ring 62 may be of the type of insulating material discussed above with a metal surface deposited on the surfaces to be soldered such as solder 64 and 60. Ring 62 supports a Kovar or other type metal contact plate 66 which in turn supports cold cathode wafer 68 and provides the "n" portion of the wafer.

Figure 3:
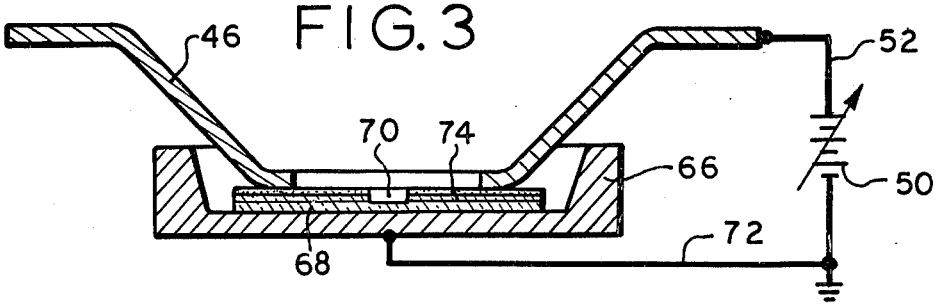
FIG. 3 is an enlarged cross-sectional view of the P-N junction for generating electrons and its contacting surfaces.

Referring to FIG. 3, cold cathode wafer 68 is shown having connected thereto resilient contact ring 46 as it is engageably positioned in the cathode assembly. A polycrystalline P-type layer deposited on wafer 68 provides the necessary electrical connection from diode 70 to the contact ring 46. Cold cathode water 68 is mechanically affixed and electrically connected to contact plate 66. During operation, lead 72 provides the necessary current return from the diode to power source 50.

Figure 4:
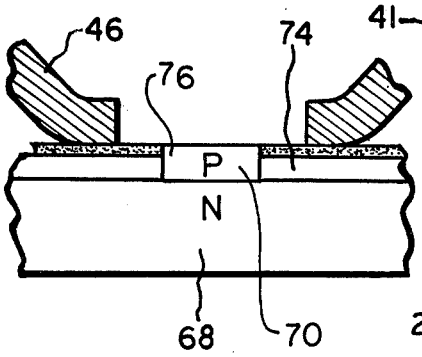
FIG. 4 depicts the intrinsic nature of the P-N junction which is treated to have a negative electron affinity.

Referring to FIG. 4, N-type wafer 68 has a coating of silicon oxide 74 which acts as a resistive layer between N-type wafer 68 and the P-layer 76. The silicon oxide layer may be developed by exposing wafer 68 to steam. A hole is created through the layer of $SiO_2$ by any well known technique and a layer of P-type silicon 76 is grown expitaxially in the hole and polycrystalline on the silicon oxide coated wafer. A P-N junction diode 70 is created in the hole and a P-type polycrystalline structure forms over the $SiO_2$ coating 74. As previously stated, the polycrystalline material provides a sufficient conduction for current flow to the P-N junction. The size of the layers and junctions are typically: diode =0.002" dia., $SiO_2$ layer=2 microns and polycrystalline "P" layer thickness is 2 microns. The diode is activated with cesium and oxygen to have a negative electron affinity at the surface of the P-N junction.

A significant feature of the device is that the cold cathode section 12 is constructed of two sections of the cathode assembly 20 and cap 22. Hence, after preparing the P-N junction 70 (on contact plate 66), which is an integral part of cap 22, the cap 22 may be force fitted over taper 24 to effect a seal. This, of course, is accomplished under the conditions of a vacuum and the taper 24 may be coated with silver to effect a gasket between cathode assembly 20 and cap 22 so that the vacuum remains inside the tube.

I claim:

1. In an electron beam tube apparatus having a face section, neck section, and cathode section constructed to generate an electron beam in a vacuum, the improvement in said cathode section comprising:

a cathode assembly including, a first electrically conductive member attached to said neck section, an electrically insulating member attached to said first member, a second electrically conductive member attached to said insulating member and constructed at one end to form a tapered surface, all of said members being constructed and attached in such a manner as to form an opening surrounded by said tapered surface at one end, a resilient metal contact attached to said second conductive member and extending within said opening, and a field electrode attached to said first conductive member and positioned within said opening; and a cap including, a first electrically conductive portion slidably engaged with said tapered surface to form a vacuum seal therewith, an electrically insulating portion attached to said first portion, an electrically conductive plate attached to said insulating portion, and a cathode attached to said electrically conductive plate in such manner that said cathode will abuttably engage said resilient contact in response to the slidable engagement of said first conductive portion with said tapered surface.

2. The apparatus of claim 1 wherein each of said members of said cathode assembly and each of said portions of said cap are constructed in an annular configuration, and wherein said field electrode is constructed in a frustro-conical configuration.

3. The apparatus of claim 2 wherein said cathode is a cold cathode formed as a P-N junction capable of emitting electrons to form said electron beam.

4. In a cold cathode electron beam tube capable of sustaining a vacuum and being used as a camera tube or a display tube and having a face section, neck section, focusing coils and power sources, the improvement comprising:

a first section including a high alumina ceramic section having a nickel plating on portions thereof affixed to the neck;

an annular metallic ring having a first, second and third surface, the first surface being affixed to the neck portion thereof;

a frustro-conical field forming electrode attached to the second surface of the annular metallic ring;

a high alumina ceramic ring having a nickel plating on portions thereof affixed to the third surface of the annular metallic ring;

a second annular metallic ring having a first, second and third surface, the first surface being affixed to the high alumina ceramic ring;

a resilient metallic electrode affixed to the third surface of the second annular metallic ring;

tubular housing means being attached to said resilient metallic electrode; and a tapered annular end portion having an inner diameter and an outer diameter, the inner diameter being connected to the tubular housing;

a second section including a cold cathode mechanically and electrically connected to a contact plate;

an annular ring in an abuttable engagement with but electrically insulated from said contact plate, said ring being of high alumina ceramic coated with nickel in portions thereof;

a cylindrical cap connected to said ring having an inside diameter which slidably engages the taper of the first section.

* * * * *